US008578819B2

(12) United States Patent
Cheung

(10) Patent No.: US 8,578,819 B2
(45) Date of Patent: Nov. 12, 2013

(54) ELECTRIC CORKSCREW

(76) Inventor: Chun Ming Cheung, Hong Kong (HK)

( * ) Notice: Subject to any disclaimer, the term of this patent is extended or adjusted under 35 U.S.C. 154(b) by 339 days.

(21) Appl. No.: 12/704,585

(22) Filed: Feb. 12, 2010

(65) Prior Publication Data

US 2010/0206136 A1 Aug. 19, 2010

(30) Foreign Application Priority Data

Feb. 12, 2009 (GB) ..... 0902328.4

(51) Int. Cl.
*B67B 7/04* (2006.01)

(52) U.S. Cl.
USPC ..... 81/3.2

(58) Field of Classification Search
USPC ..... 81/3.2, 3.45
See application file for complete search history.

(56) References Cited

U.S. PATENT DOCUMENTS

| | | | | |
|---|---|---|---|---|
| 4,607,543 | A | 8/1986 | Mah | |
| 5,372,054 | A | 12/1994 | Federighi | |
| 5,724,869 | A * | 3/1998 | May | 81/3.2 |
| 6,321,620 | B1 * | 11/2001 | Fabbro | 81/3.2 |
| 7,234,375 | B1 * | 6/2007 | Wang Wu | 81/3.2 |
| 2003/0029276 | A1 * | 2/2003 | Falcone | 81/3.2 |
| 2003/0196519 | A1 * | 10/2003 | Graffin | 81/3.2 |
| 2003/0230172 | A1 | 12/2003 | Lee | |

FOREIGN PATENT DOCUMENTS

| | | | | |
|---|---|---|---|---|
| BE | 1014985 | A7 | 3/2004 | |
| DE | 10115085 | C1 | 7/2002 | |
| EP | 1496010 | A1 | 1/2005 | |
| EP | 10153511.0-1261 | | 6/2010 | |
| FR | 2608143 | A1 * | 6/1988 | |
| FR | 2693449 | A1 | 1/1994 | |
| GB | 2199813 | A * | 7/1988 | |
| GB | 2389846 | A | 12/2003 | |
| GB | 0902328.4 | | 5/2009 | |
| GB | 2467756 | A * | 8/2010 | B67B 7/04 |
| WO | WO99/52809 | A1 | 10/1991 | |
| WO | WO94/01359 | A1 | 1/1994 | |

* cited by examiner

*Primary Examiner* — David B Thomas
(74) *Attorney, Agent, or Firm* — Daniel Schein, Esq.

(57) ABSTRACT

A corkscrew for removing a cork or a stopper from a bottle containing wine, or other beverage or food product is disclosed. The corkscrew has socket (19) which is provided with vertical axis that is dimensioned to receive the neck of a bottle, while corkscrew spiral (2) is arranged axially within the socket. A CPU is electrically communicated with battery pack, and is charged to determine whether the battery pack can perform sufficient work to open a cork and to provide a signal to the LED display (13) that indicates the number of corks which can be removed using the corkscrew. The corkscrew can be operated with one hand since physical force or dexterity are not required to operate the corkscrew, and prevents accidental injury or damaging of work surface since CPU is electrically communicated with battery pack.

15 Claims, 9 Drawing Sheets

ELECTRIC CORKSCREW

This invention relates to an electrically powered corkscrew of the kind used for removing corks or stoppers from bottles containing wine, other beverages or food products.

OBJECT OF THE INVENTION

Conventional corkscrews are manually operated. Manual operation may be inconvenient or difficult for users lacking the necessary strength or dexterity. Removal of corks made from plastics material can be especially difficult requiring considerable force, so that there is a risk of spillage or injury to a user.

BRIEF DESCRIPTION OF THE INVENTION

In the following specification the construction and use of the corkscrew are described in relation to a bottle standing vertically upright. However it should be understood that the corkscrew of this invention may be used to open a bottle inclined to the vertical.

According to a first aspect of the present invention a corkscrew comprises:

- a casing;
- a downwardly opening socket within the casing, the socket having a vertical axis being dimensioned to receive the neck of a bottle;
- a corkscrew spiral arranged axially within the socket;
- a motor adapted to rotate the spiral in clockwise and anti-clockwise directions;
- a power supply battery;
- a sleeve having an axial bore mounted for axial movement within the socket;
- spring means adapted to bias the sleeve downwardly within the socket;
- a control circuit including a microprocessor and a memory;
- a display;
- and an upper position sensor;
- the motor upon actuation causing the spiral to rotate in a first direction to penetrate the cork and withdraw the cork from the bottle neck;
- the axial bore being configured to receive and engage the cork preventing rotation of the cork;
- the upper position sensor being adapted to detect when the cork is completely removed from the bottle and to generate a signal to stop rotation of the spiral;
- the microprocessor being in electrical communication with the battery and being arranged to determine whether the battery is able to perform sufficient work to open a cork and to provide a signal to the display indicating the number of corks which may be removed using the corkscrew.

Preferably the signal indicates the number of available cork removal cycles. In this way a user can ascertain that a cork can be removed and completely discharged before recharging is required. Removal of a cork from the spiral part way through a cycle may be difficult and hazardous.

Preferably the microprocessor includes a memory arranged to store:

- the work required to complete a cork removal cycle;
- the work available in the battery; and
- the number of possible cork removal cycles.

The memory is preferably further arranged to store:

- the number of times the battery has been charged; and
- values of the battery capacity as a function of the number of times the battery has been charged.

The corkscrew may further include a sensor arranged to provide a signal to the microprocessor indicating the charge state of the battery.

The microprocessor may be arranged to receive a value of the current supplied to the battery and to integrate the value over time to obtain a value of the total charge input to the battery and further arranged to store the total charge input value in the memory.

Preferably the microprocessor is arranged to update the display after each cork removal cycle.

In a further embodiment of the invention the corkscrew may comprise:

- a casing;
- a downwardly opening socket within the casing, the socket having a vertical axis being dimensioned to receive the neck of a bottle;
- a corkscrew spiral arranged axially within the socket;
- a motor adapted to rotate the spiral in clockwise and anti-clockwise directions;
- a power supply;
- a sleeve having an axial bore mounted for axial movement within the socket;
- spring means adapted to bias the sleeve downwardly within the socket;
- a control circuit including a microprocessor;
- lower and upper position sensors;
- the lower position sensor being adapted to detect the neck of a bottle inserted into the socket with the point of the spiral adjacent a cork located in the neck and to generate a signal to activate the motor;
- the motor upon actuation by a signal from the lower position sensor causing the spiral to rotate in a first direction to penetrate the cork and withdraw the cork from the bottle neck;
- the axial bore being configured to receive and engage the cork preventing rotation of the cork;
- the upper position sensor being adapted to detect when the cork is completely removed from the bottle and to generate a signal to stop rotation of the spiral;
- and wherein removal of the bottle from the socket actuates the lower position sensor to send a signal to the motor to rotate in a reverse direction to disengage the cork from the spiral;

According to a second aspect of the present invention, a corkscrew comprises:

- a casing;
- a downwardly opening socket within the casing, the socket having a vertical axis being dimensioned to receive the neck of a bottle;
- a corkscrew spiral arranged axially within the socket;
- a motor adapted to rotate the spiral in clockwise and anti-clockwise directions;
- a power supply;
- a sleeve having an axial bore mounted for axial movement within the socket;
- spring means adapted to bias the sleeve downwardly within the socket;
- a control circuit including a microprocessor;
- lower and upper position sensors;
- the lower position sensor being adapted to detect the neck of a bottle inserted into the socket with the point of the spiral adjacent a cork located in the neck and to generate a signal to activate the motor;
- the motor upon actuation by a signal from the lower position sensor causing the spiral to rotate in a first direction to penetrate the cork and withdraw the cork from the bottle neck;

the axial bore being configured to receive and engage the cork preventing rotation of the cork;

the upper position sensor being adapted to detect when the cork is completely removed from the bottle and to generate a signal to stop rotation of the spiral;

and wherein removal of the bottle from the socket actuates the lower position sensor to send a signal to the motor to rotate in a reverse direction to disengage the cork from the spiral.

In a preferred embodiment the lower sensor may comprise a member which may engage the neck of a bottle and be urged upwardly against the force of a spring means to generate a signal. For example the sensor may comprise an annular member having an upwardly facing conductive portion, the member being biassed by a spring downwardly away from a pair of contacts to form an open circuit, the member being urged upwardly against the force of the spring by contact with the neck of a bottle to close the contacts to generate a signal indicative of the presence of the bottle neck within the socket.

In an alternative embodiment the lower position sensor may comprise a pair of C-shaped members connected by a hinge or an annular member dimensioned to receive the neck of a bottle and arranged to open or dilate upon insertion of the bottle neck, the sensor including a pair of contacts being arranged to disengage to generate a signal indicative of the presence of a bottle neck within the socket.

The upper position sensor may be adapted to detect a cork on the spiral at the top of the socket to generate a signal to stop further rotation of the spiral. In a preferred embodiment the sleeve may engage the upper position sensor when a cork is in the upper position. The upper surface of the sleeve may include an upwardly facing conductive strip. The sensor may comprise a pair of contacts closed by the conductive strip on an upper surface of the sleeve.

The sleeve may comprise an open or closed structure which defines a cylindrical cavity to receive all or part of a cork, preventing rotation of a cork as the spiral rotates. Axially extending splines or other projections may extend into the cavity to engage the surface of the cork.

The sleeve may be composed of rubber or other high friction material. Alternatively the sleeve may be composed of an engineering plastics material and suitably configured to engage the cork in use; for example by provision of splines or other projections which extend into the cavity. Alternatively the sleeve may have a diameter selected to tightly receive and engage the cork preventing rotation as it is withdrawn by the rotating spiral.

The power supply may comprise a rechargeable battery, optionally with a connection to a mains or low voltage power supply. Disposable batteries may be employed.

In a preferred embodiment the corkscrew includes a docking station containing a charging unit for charging the rechargeable batteries when standing by. The docking station may be connected to an external voltage transformer. Each of the corkscrew and docking station may be provided with two metal contacts so that when the corkscrew is placed on the docking station the contacts are engaged. One or more LED's liquid crystal or other displays may be provided on the corkscrew body or on the docking station to indicate the charging status.

The sensors may include a temperature sensor for measuring and monitoring the external temperature of the battery to prevent overheating of the battery. The sensor may also measure and monitor the rate of temperature rise of the battery for reference in charging and discharging the battery.

A voltage sensor may be provided to monitor the input voltage and input current to the battery during charging and the output voltage and output current during use of the corkscrew.

A shake sensor may be provided to detect movement of the corkscrew in order activate the back light of a visual display when the unit is picked up. The shake sensor may comprise a coiled spring and steel or iron needle threaded through the spring. Lightly shaking the corkscrew causes the spring to touch the needle generating a signal to the CPU to activate the system from a stand by state A digital display can provide an indication of the number of corks which can be removed using the remaining work which can be prepared by the battery. An indication of the number of complete cork removal cycles which can be achieved using the remaining available work is preferably displayed.

In preferred embodiments the display indicates that the corkscrew should be recharged before the battery is fully depleted, preventing the corkscrew from stopping in the middle of a cycle.

Two or more external switches may be provided to actuate the functions of the corkscrew. The switches may be used instead of the lower sensor or as an alternative in situations where manual control is desired for example with long or difficult corks.

A corkscrew in accordance with this invention confers a number of advantages. Physical force or dexterity are not required to operate the corkscrew, and furthermore the corkscrew may be operated with one hand, leaving the other hand free to hold the bottle.

The point of the spiral may not extend beyond the opening of the socket so that accidental injury or damage to a work surface is prevented.

It is an important feature of preferred embodiments of this invention that control means are provided to prevent actuation to remove a cork if the battery is not able to provide sufficient work to complete removal of the cork from the bottle neck and discharge of the removed cork from the spiral. Insufficient available work may result in the cork remaining stuck while still in the bottle or within the body of the corkscrew. In this event, engagement of the corkscrew within a docking station for recharging may be impossible or impeded.

A preferred embodiment of the invention incorporates a control unit. The control unit may comprise a CPU and a battery management control unit. The battery management control unit may be integral with the CPU or may comprise a separate integrated circuit.

The CPU may provide control signals to the motor control circuit or relay to control the forward and reverse motion of the motor.

The battery management circuit may further comprise a sensor adapted to generate a signal dependent on the voltage and/or current drawn by the battery pack. This serves to provide an indication of the available work and the charging condition of the battery.

A DC power supply, for example from a docking station, may include a switch so that no power is supplied to the motor when the battery is charging and so that no power is delivered to the battery when the motor is in use.

The battery management control unit may include a memory arranged to store the value of battery capacity as a function of battery life and the work required to extract an average cork.

The service life of the battery may be stored as a total number of charging and discharging cycles, so that the battery capacity during the service life of the corkscrew is known.

The control unit is preferably adapted to calculate the total number of corks with average tightness which may be opened using a given battery capacity. Each time a cork is removed the battery capacity value is updated by the CPU.

BRIEF DESCRIPTION OF THE DRAWINGS

The invention is further described by means of example but not in any limitative sense with reference to the accompanying drawings of which.

DETAILED DESCRIPTION OF THE INVENTION

Figure 1:
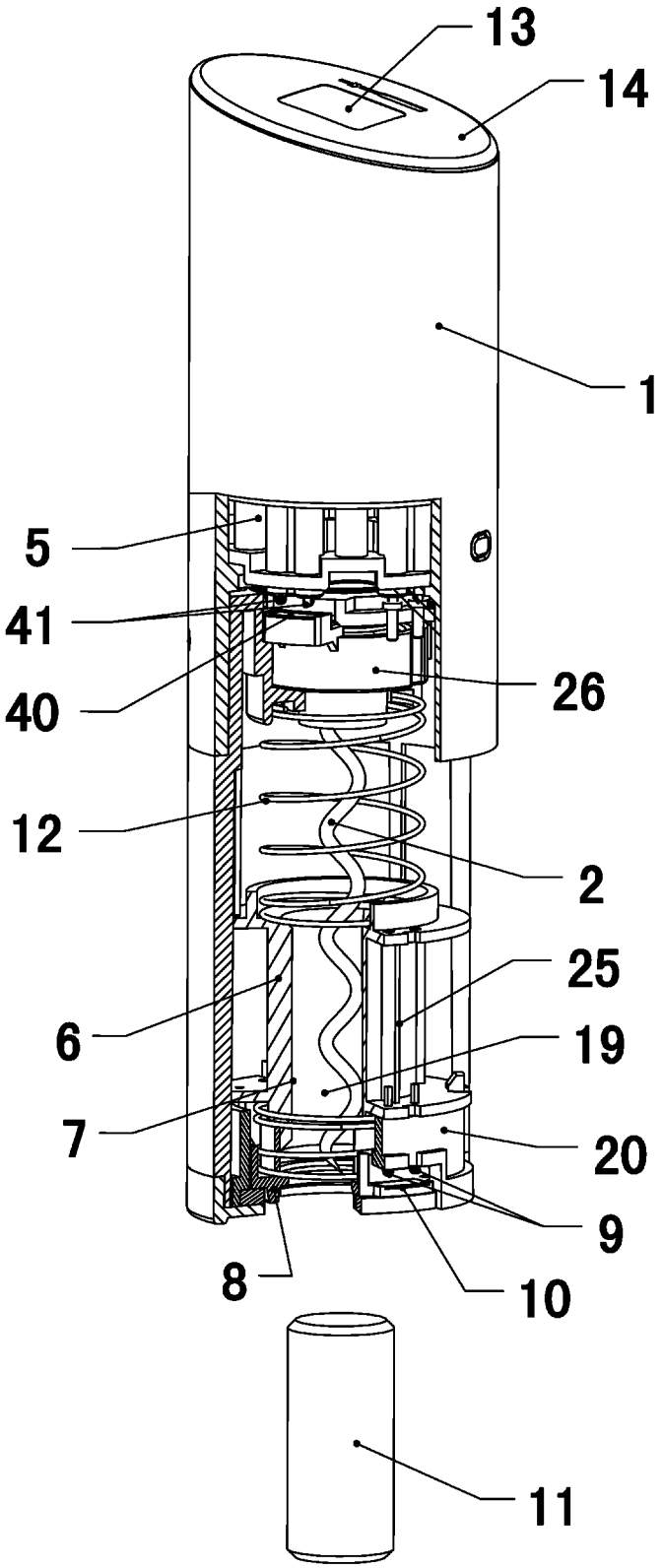
FIG. 1 is a partly cut away elevation of a corkscrew in accordance with this invention.
Figure 2:
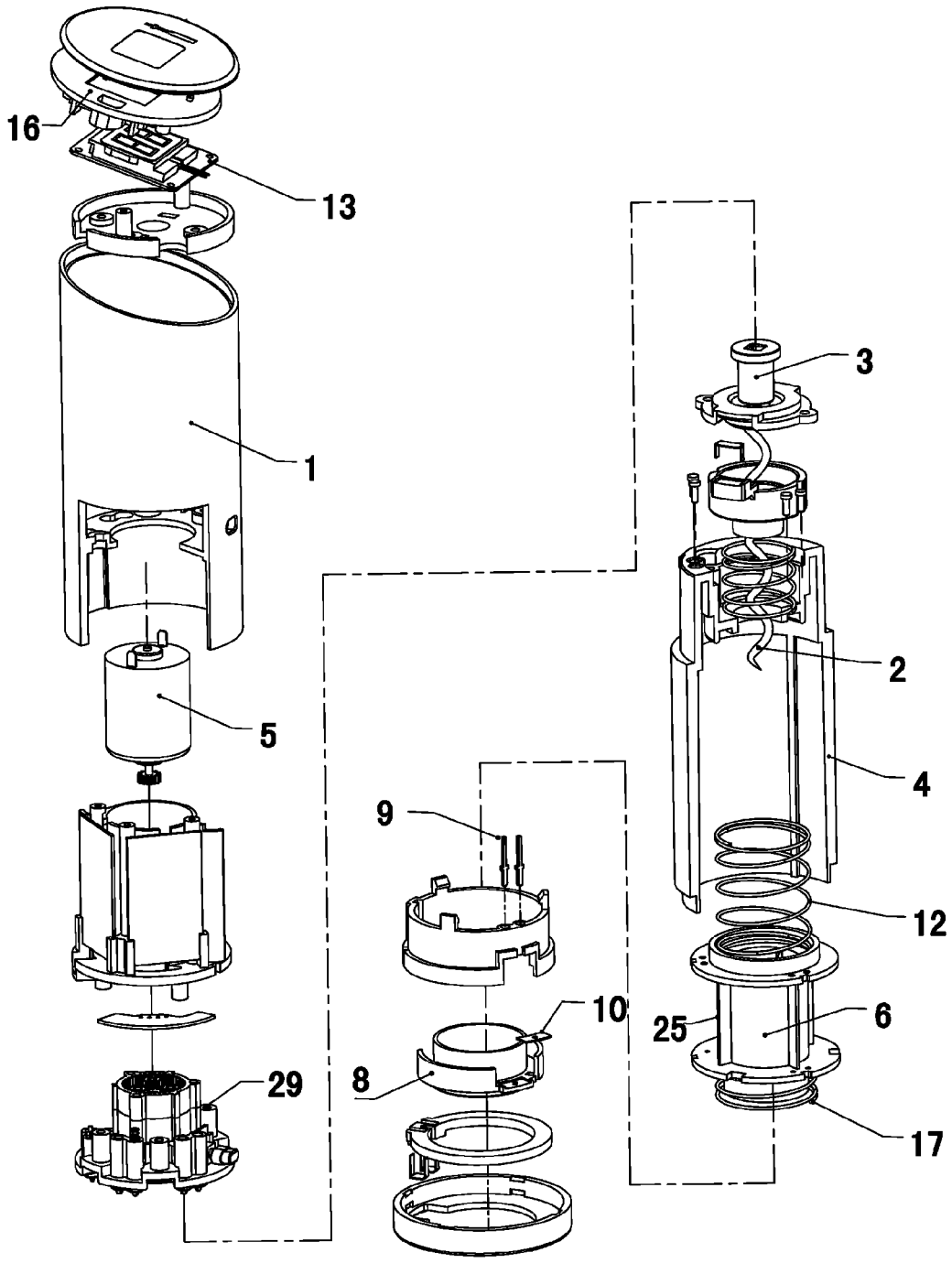
FIG. 2 is an exploded view of the corkscrew shown in FIG. 1.

The corkscrew shown in FIGS. 1 and 2 comprises an upper casing (1) and lower casing (4) with a pointed corkscrew spiral (2) axially mounted on bearing (3) located within the upper casing. The spiral is located axially within a generally cylindrical downwardly opening socket (19). In an alternative embodiment a single unitary casing may be employed. A DC motor (5) is connected to the spiral (2) by means of a reduction gear box (29). The DC motor is arranged to run in forward or reverse directions as controlled by a CPU (13). A speed control may be also provided.

A sleeve (6) having an axial cylindrical bore (7) is mounted on runners (25) for sliding movement in an axial direction within the lower casing (4). A spring (12) urges the sleeve on annular ring (70) downwardly towards the opening of the socket (19). A spring (17) urges a moveable annular sensor ring (8) downwardly so that an upwardly facing metallic contact portion (10) is urged to disengage a pair of contacts (9) to give an open circuit.

When the neck of a bottle (not shown) is inserted into the socket to engage the sensor ring (8), the sensor ring is moved upwardly so that the contacts (9) and (10) are engaged to complete a circuit providing a signal indicating that the corkscrew has engaged the neck of a bottle. The sensor ring and contacts (9) and (10) comprise the lower position sensor.

An LED display (13) located in the top plate (16) beneath a cover (14) of the casing (1) provides a display. The display may show the maximum number of corks which may be removed before the battery becomes depleted.

A metallic strip (40) disposed on axially moveable upper cap (26) cooperates with contacts (41) to form an upper position sensor. The contacts (40) and (41) are engaged when the sleeve (6) and cork (11) are in their uppermost position so that the upper cap (26) is urged upwardly so that the contact strip (40) are pressed into engagement with contacts (41). This provides a signal to the CPU (13).

The operation of the corkscrew is as follows:

In the standby stage the contacts for the upper position indicator are open and the contacts for the lower position indicator are closed. The motor is off.

When a bottle is inserted into the socket, the cork still being within the bottle, the contacts of the upper position sensor are open. The originally closed contacts of the lower position sensor are opened by the engagement with the neck of the bottle. Opening of the contacts sends a signal which actuates the motor so that the spiral is driven in a forward direction causing the point of the spiral to penetrate the cork as the user applies downward pressure on the corkscrew. Rotation continues so that the cork is withdrawn from the bottle as it travels upwardly along the spiral until it is completely removed from the neck of the bottle. The spiral then raises the cork and the sleeve to the upper part of the socket until the sleeve or cork contacts the upper position sensor closing the contacts of the upper position sensor. A signal is sent to the CPU to cause the motor to stop rotation. At this stage the opening of the bottle is completed. The bottle remains within the corkscrew body but the cork has been removed from the bottle and remains on the spiral. The upper position sensor switch contacts are closed and the lower position sensor contacts are open. The motor is turned off.

The bottle may then be removed from the corkscrew. Removal of the neck of the bottle from the socket allows closure of the contacts of the lower position sensor. The signal sent to the CPU causes the motor to rotate in the reverse direction for a limited period sufficient to discharge the cork from the spiral.

Figure 3:
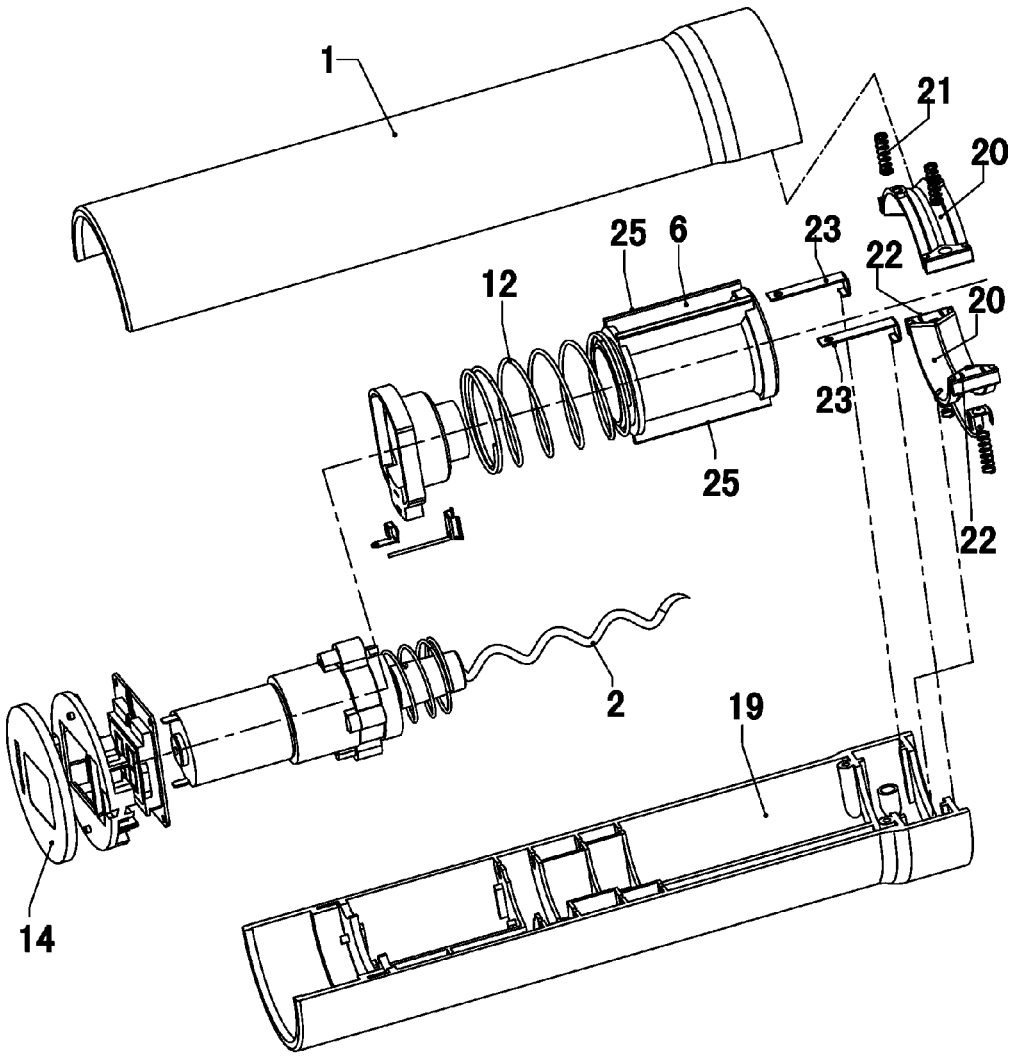
FIG. 3 is an exploded view of an alternative embodiment of the invention.
Figure 4:
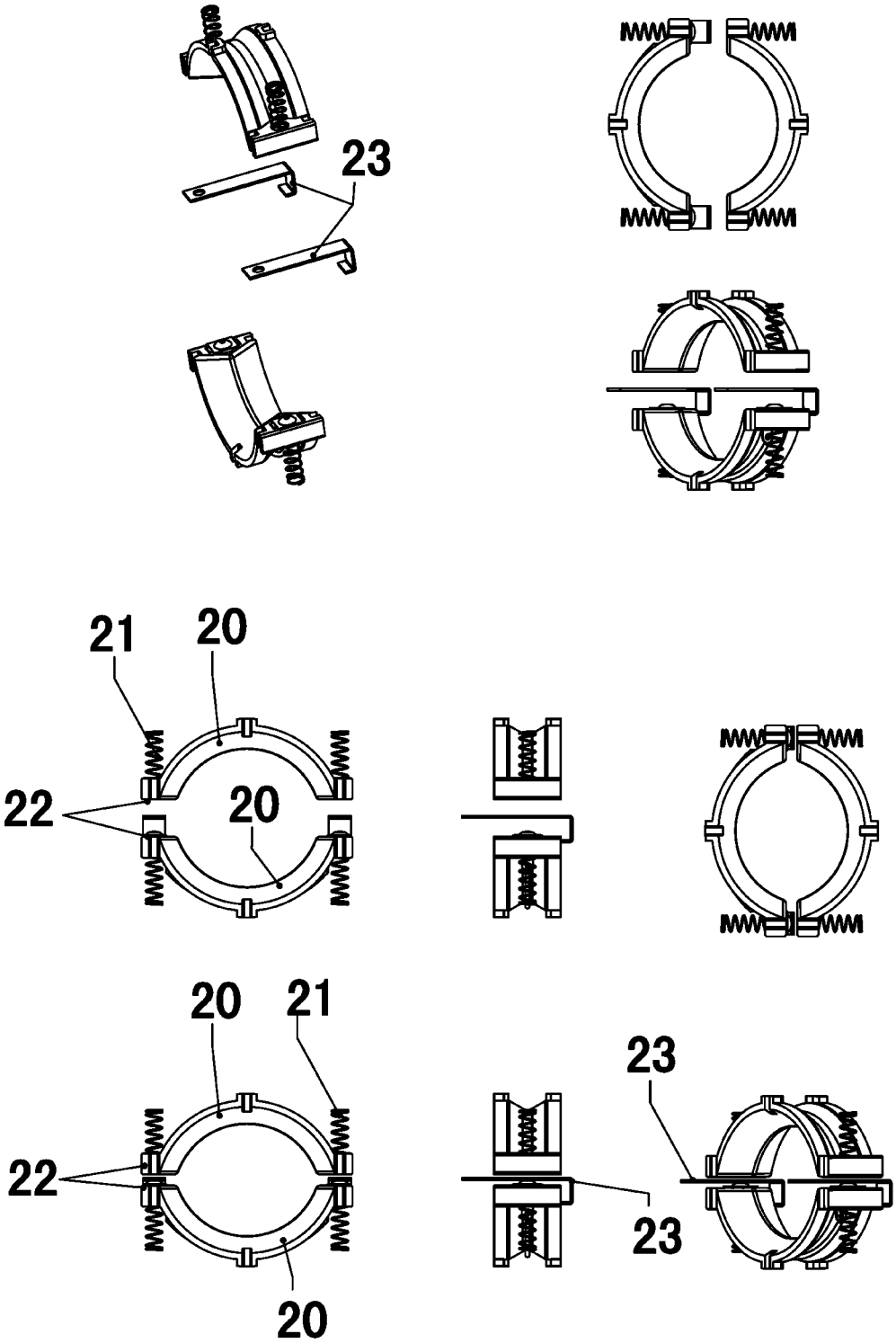
FIG. 4 illustrates the lower position sensor of the corkscrew shown in FIG. 3.

FIG. 3 shows an alternative embodiment of the invention wherein the lower position sensor comprises two-part circular members (20) which together form a generally annular entrance to the socket (19). The members (20) are biased by springs (21) towards each other so that contacts (22) are engaged. When the neck of a bottle is inserted between the members (20), the contacts are opened sending a signal to the CPU that the motor may be actuated. The arrangement of the contacts is shown in more detail in FIG. 4. Contact strips (23) extend between the contacts (22) to connect the sensor to the CPU circuit.

The function of this embodiment is similar to the function of the first embodiment.

Figure 5:
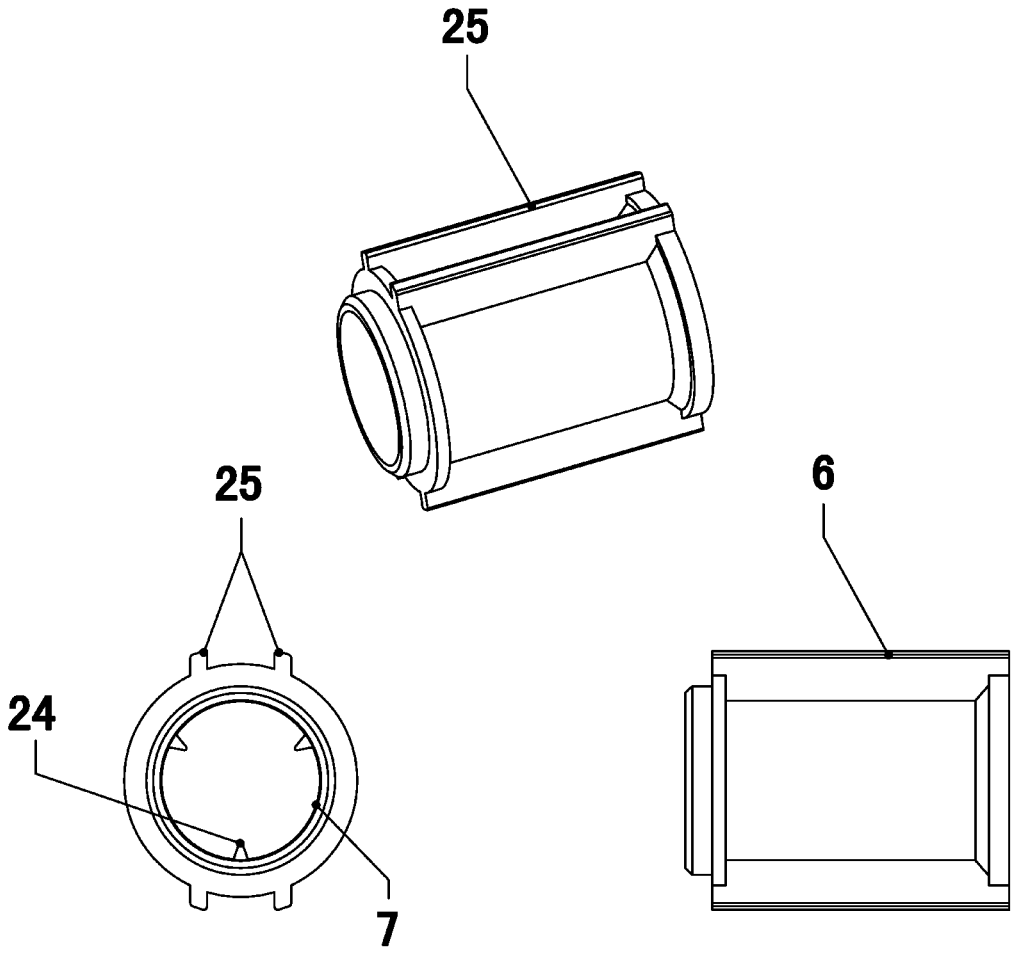
FIG. 5 illustrates the sleeve.

FIG. 5 shows the sleeve in greater detail. Axial splines (24) extend radially inwardly of the cylindrical bore (7) to engage the surface of a cork preventing rotation of the cork as the spiral rotates. Runners (25) allow the sleeve to move upwardly or downwardly without rotation within the housing. A spring (12) urges the sleeve downwardly so that it is ready to receive a cork (11) at the start of the cycle.

Figure 6:
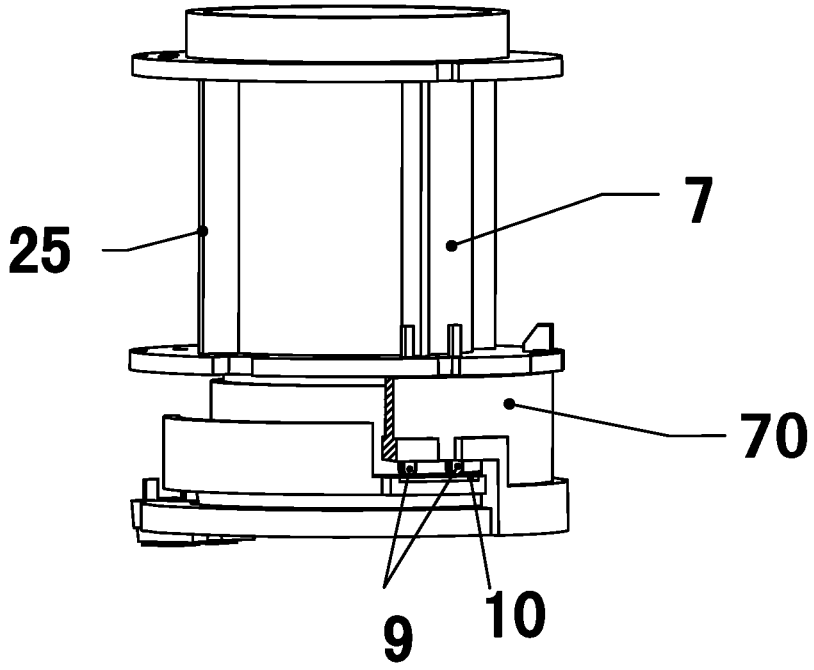
FIG. 6 is an elevation showing the sleeve and lower position sensor of the embodiment shown in FIGS. 1 and 2.

The arrangement of the sleeve and lower position sensor of the embodiment shown in FIGS. 1 and 2 is shown in more detail in FIG. 6.

Figure 7:
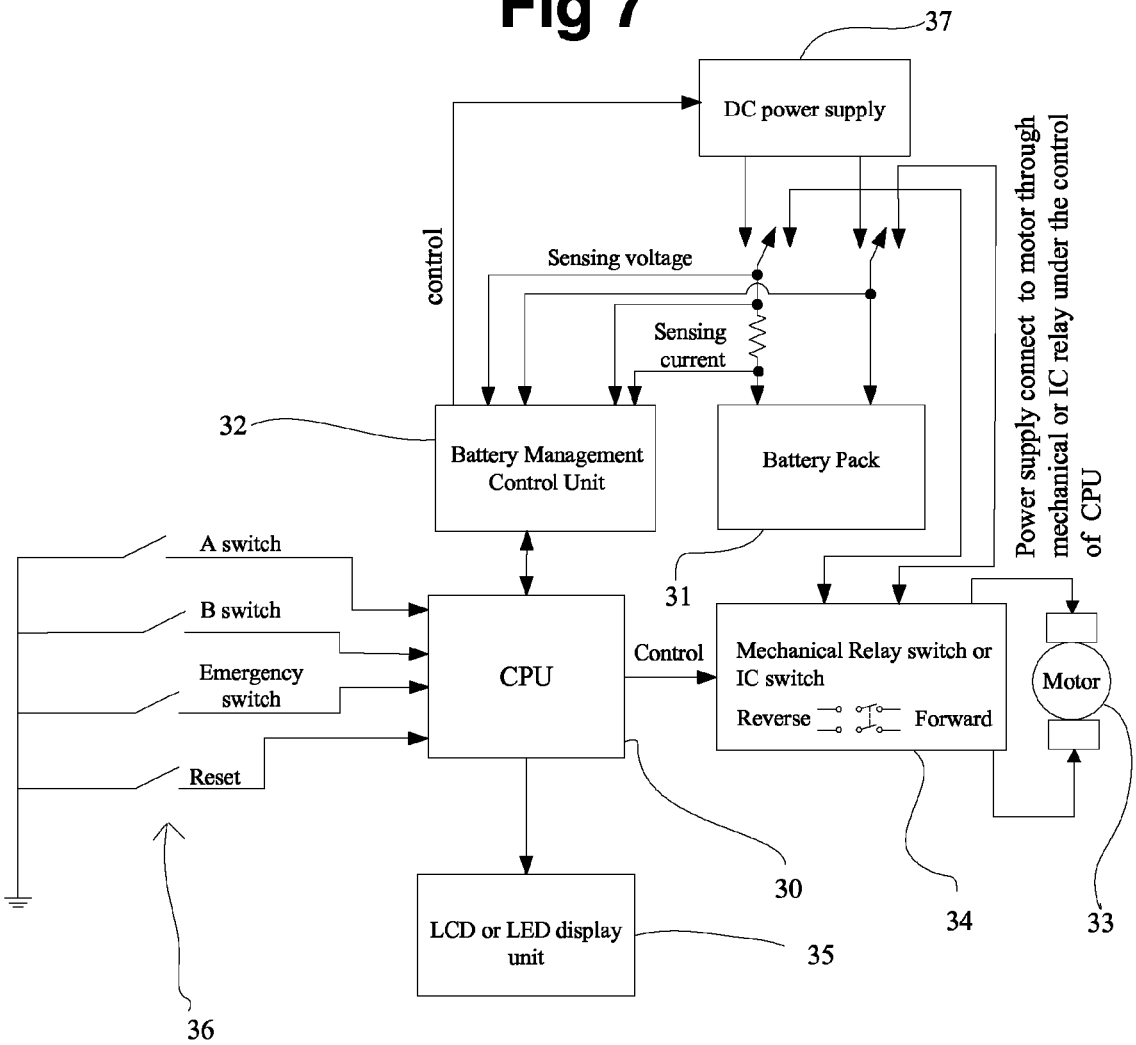
FIG. 7 illustrates the circuit of the corkscrew.

FIG. 7 shows the circuitry of the corkscrew. A CPU (30) is connected to a battery management control unit (32). The battery management control unit may be either a standalone IC or may be integrated within the CPU. An LED or LCD digital display (35) displays the number of corks to be opened. The LED or LCD digital display (35) is connected to the CPU A motor control circuit or mechanical relay (34) which is connected in turn to motor (33). The motor control IC or mechanical relay controls the forward and reverse motion of the motor under control of the CPU (30). A battery pack (31) comprising rechargeable batteries is provided with means for connection to a DC power supply (37). The DC supply (37) when charging supplies no power to the motor (33) and when the motor is in use no charging is supplied to the battery pack (31).

An array of switches (36) comprise A and B switches for the upper and lower position sensors respectively, an emergency switch and a reset switch. A current sensor circuit (38)

allows control of the charging of the battery (31) and control circuit (39). The power supply to the motor (33) is under the control of the motor control 1C (34).

Figure 8:
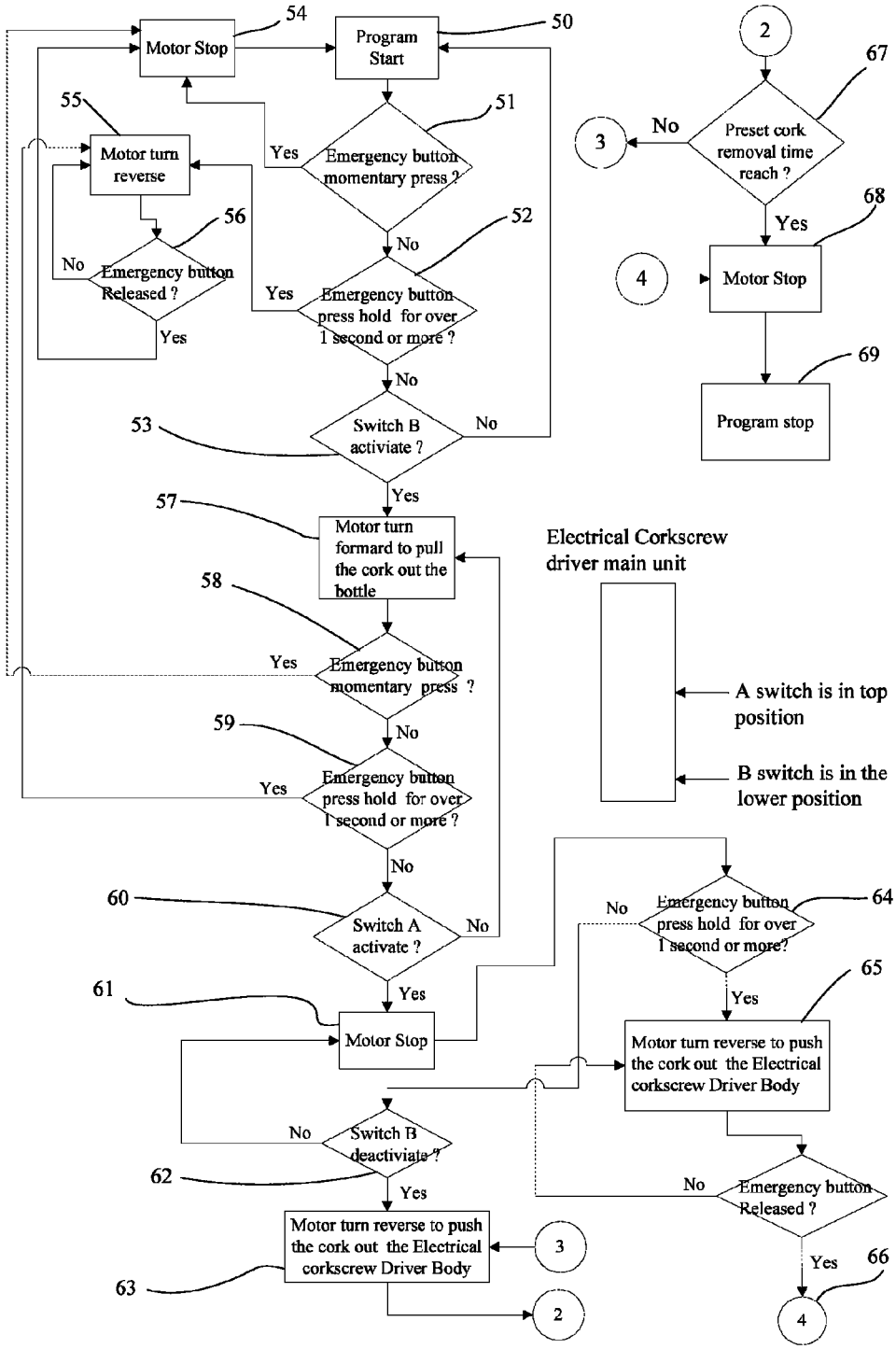
FIG. 8 is a flow chart for the operation of the corkscrew.

FIG. 8 is a flow chart illustrating the function of the corkscrew. Following the starting of the program (50) an emergency button may be actuated momentarily (51) to stop the motor (54). If the emergency button is pressed for more than one second (52) the motor is reversed (55) until the emergency button is released (56). If the emergency button is not actuated then the lower position sensor, switch B is interrogated (53). If the switch is activated the motor turns forwardly to penetrate a cork and pull the cork out of the bottle (57). Actuation of the emergency button momentarily (58) will stop the motor or if actuated for more than one second (59) causes the motor to reverse until the emergency button is released. Once the cork has been removed and withdrawn to the top position within the socket, the upper position sensor, or a manual switch A is activated (60) causing the motor to stop (61). If the emergency button is held for more than one second (64) then the motor is reversed to push the cork out of the corkscrew body (65) until the emergency button is released. After removal of the neck of the bottle the lower position sensor, or a manual switch B is deactivated (62) causing the motor to reverse to push the corkscrew out of the driver body (63) for a preset time (67) after which the motor is stopped (68) and the program terminated (69).

Figure 9:
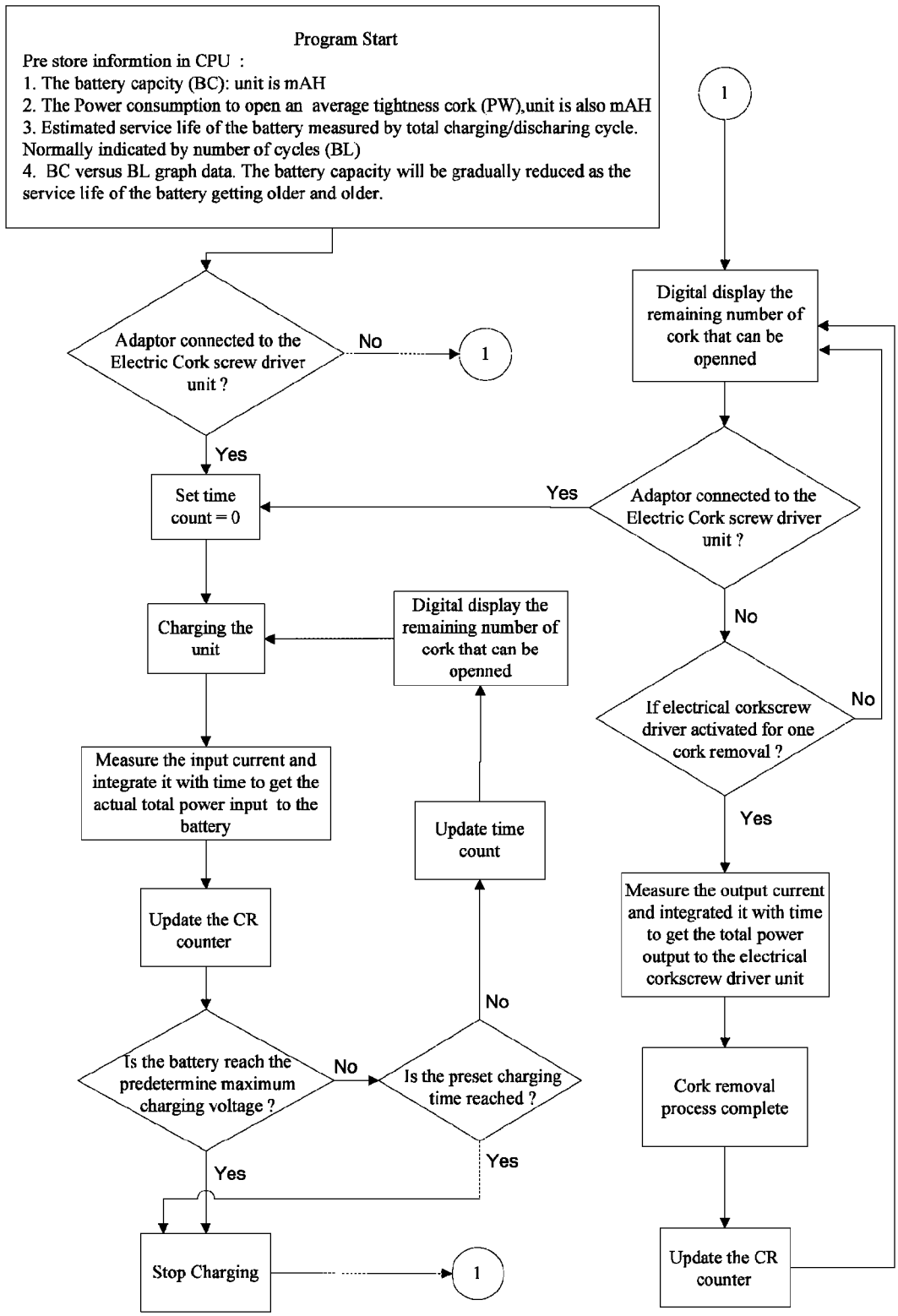
FIG. 9 is a flow chart illustrating the battery capacity measuring circuit.

FIG. 9 illustrates the processing steps for ensuring that the battery is adequately charged before use. The battery capacity (BC) power consumption to open an average cork (PW) estimated life of the battery, normally indicated by a number of cycles (BL) and a graph of battery capacity versus battery life are pre-stored in the central processing unit. The battery capacity will gradually reduce as the service life of the battery increases. The total number of corks with average tightness that can be opened with a given battery capacity (BC) is represented by (CR). Each time the battery is charged the CPU automatically updates the BC value. Each time the corkscrew driver unit is actuated for cork removal the BC value is substracted after each operation cycle. The steps of estimating the CR value are shown in the flow chart of FIG. 10.

The number of corks that can be opened is determined by the formula DC/PW. The CPU is arranged to make an adjustment as time goes by based on the BC versus BL data.

The invention claimed is:

1. A corkscrew comprising:

a casing;

a downwardly opening socket within the casing, the socket having a vertical axis being dimensioned to receive the neck of a bottle;

a corkscrew spiral arranged axially within the socket;

a motor adapted to rotate the spiral in clockwise and anticlockwise directions;

a battery;

a sleeve having an axial bore mounted for axial movement within the socket;

spring means adapted to bias the sleeve downwardly within the socket;

a control circuit including a microprocessor and a memory;

a display;

and an upper position sensor;

the motor upon actuation causing the spiral to rotate in a first direction to penetrate the cork and withdraw the cork from the bottle neck;

the axial bore being configured to receive and engage the cork wherein axial splines extend inwardly of the bore to engage the cork preventing rotation of the cork;

the upper position sensor being adapted to detect when the cork is completely removed from the bottle and to generate a signal to stop rotation of the spiral;

the microprocessor being in electrical communication with the battery and being charged to determine whether the battery is able to perform sufficient work to open a cork and to provide a signal to the display indicating the number of corks which may be removed using the corkscrew.

2. A corkscrew as claimed in claim 1, wherein signal indicates the number of available cork removal cycles.

3. A corkscrew as claimed in claim 1, wherein the microprocessor includes a memory arranged to store:

the work required to complete a cork removal cycle;

the work available in the battery; and the number of possible cork removal cycles.

4. A corkscrew as claimed in claim 1, wherein the memory is further arranged to store:

the number of times the battery has been charged; and values of the battery capacity as a function of the number of times the battery has been charged.

5. A corkscrew as claimed in claim 1, further including a sensor arranged to provide a signal to the microprocessor indicating the charge state of the battery.

6. A corkscrew as claimed in claim 5, wherein the microprocessor is arranged to receive a value of the current supplied to the battery and to integrate the value over time to obtain a value of the total charge input to the battery and further arranged to store the total charge input value in the memory.

7. A corkscrew as claimed in claim 1, wherein the microprocessor is arranged to update the display after each cork removal cycle.

8. A corkscrew as claimed in claim 1, wherein the sleeve comprises an open or closed structure which defines a cylindrical cavity to receive all or part of a cork to prevent rotation of all or part of the cork as the spiral rotates.

9. A corkscrew as claimed in claim 1, further comprising:

lower and upper position sensors;

the lower position sensor being adapted to detect the neck of a bottle inserted into the socket with the point of the spiral adjacent a cork located in the neck and to generate a signal to activate the motor;

the motor upon actuation by a signal from the lower position sensor causing the spiral to rotate in a first direction to penetrate the cork and withdraw the cork from the bottle neck;

wherein removal of the bottle from the socket actuates the lower position sensor to send a signal to the motor to rotate in a reverse direction to disengage the cork from the spiral.

10. A corkscrew as claimed in claim 9, wherein the lower sensor comprises a member that is arranged to engage the neck of a bottle and is urged upwardly against the force of a spring to generate a signal.

11. A corkscrew as claimed in claim 9, wherein the lower sensor comprises a member that includes an upwardly facing conductive portion.

12. A corkscrew as claimed in claim 11, wherein the conductive portion is biased downwardly by a spring away from a pair of contacts.

13. A corkscrew as claimed in claim 9, wherein the member is urged upwardly in use by contact with the neck of a bottle so that the conductive member closes the contacts to generate a signal indicative of the presence of a bottle neck within the socket.

14. A corkscrew as claimed in claim 9, wherein the lower position sensor comprises an annular member.

15. A corkscrew as claimed in claim 9, wherein the upper position sensor is adapted to detect a cork on the spiral at the top of the socket.

* * * * *

UNITED STATES PATENT AND TRADEMARK OFFICE

CERTIFICATE OF CORRECTION

PATENT NO. : 8,578,819 B2
APPLICATION NO. : 12/704585
DATED : November 12, 2013
INVENTOR(S) : Chun Ming Cheung It is certified that error appears in the above-identified patent and that said Letters Patent is hereby corrected as shown below:

In the Claims

Column 7, lines 45-67 through column 8, lines 1-9

Claim 1 is replaced with the correct text of Claim 1 as follows:

1. A corkscrew comprising: a casing; a downwardly opening socket within the casing, the socket having a vertical axis being dimensioned to receive the neck of a bottle; a corkscrew spiral arranged axially within the socket; a motor adapted to rotate the spiral in clockwise and anticlockwise directions; a battery; a sleeve having an axial bore mounted for axial movement within the socket; spring means adapted to bias the sleeve downwardly within the socket; a control circuit including a microprocessor and a memory; a display; the motor upon actuation causing the spiral to rotate in a first direction to penetrate the cork and withdraw the cork from the bottle neck; the axial bore being configured to receive and engage the cork wherein axial splines extend inwardly of the bore to engage the cork preventing rotation of the cork; the microprocessor being in electrical communication with the battery and being charged to determine whether the battery is able to perform sufficient work to open a cork and to provide a signal to the display indicating the number of corks which may be removed using the corkscrew.

Signed and Sealed this
Twenty-fifth Day of March, 2014

Michelle K. Lee

Michelle K. Lee
*Deputy Director of the United States Patent and Trademark Office*